US008033821B2

(12) United States Patent
Eroglu

(10) Patent No.: US 8,033,821 B2
(45) Date of Patent: Oct. 11, 2011

(54) PREMIX BURNER FOR A GAS TURBINE

(75) Inventor: Adnan Eroglu, Untersiggenthal (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 12/788,712

(22) Filed: May 27, 2010

(65) Prior Publication Data

US 2010/0273117 A1 Oct. 28, 2010

Related U.S. Application Data

(63) Continuation of application No. PCT/EP2008/065116, filed on Nov. 7, 2008.

(30) Foreign Application Priority Data

Nov. 27, 2007 (CH) ..... 1838/07

(51) Int. Cl.
*F23M 3/00* (2006.01)

(52) U.S. Cl. ..... 431/9; 431/350; 431/12; 431/181; 431/182; 431/183

(58) Field of Classification Search ..... 431/9, 8, 431/12, 181, 182, 183, 350, 351, 352, 353, 431/354

See application file for complete search history.

(56) References Cited

U.S. PATENT DOCUMENTS

| | | | |
|---|---|---|---|
| 4,932,861 | A | 6/1990 | Keller et al. |
| 5,588,826 | A | 12/1996 | Dobbeling et al. |
| 5,833,451 | A | 11/1998 | McMillan |
| 6,045,351 | A | 4/2000 | Dobbeling et al. |
| 6,126,439 | A | 10/2000 | Knopfel et al. |
| 6,769,903 | B2 | 8/2004 | Eroglu et al. |
| 2002/0189257 | A1 | 12/2002 | Steinbach et al. |
| 2004/0055307 | A1 | 3/2004 | Knoepfel |
| 2006/0154192 | A1 | 7/2006 | Flohr et al. |
| 2007/0099142 | A1 | 5/2007 | Flohr et al. |
| 2007/0259296 | A1 | 11/2007 | Knoepfel |
| 2008/0115497 | A1 | 5/2008 | Eroglu et al. |
| 2008/0280239 | A1 | 11/2008 | Carroni et al. |
| 2010/0146983 | A1 * | 6/2010 | Hellat et al. ..... 60/772 |

FOREIGN PATENT DOCUMENTS

| | | | |
|---|---|---|---|
| DE | 19757189 | A1 | 6/1999 |
| DE | 10104695 | A1 | 8/2002 |
| DE | 102005015152 | A1 | 10/2006 |
| EP | 0321809 | A1 | 6/1989 |
| EP | 0704657 | A2 | 4/1996 |
| EP | 0778445 | A2 | 6/1997 |
| EP | 0833105 | A | 4/1998 |
| EP | 1213536 | A | 6/2002 |
| EP | 1292795 | A1 | 3/2003 |
| WO | 9317279 | A1 | 9/1993 |

(Continued)

*Primary Examiner* — Alfred Basichas
(74) *Attorney, Agent, or Firm* — Volpe and Koenig, P.C.

(57) ABSTRACT

A premix burner is provided, with a swirl generator and a downstream mixer tube for combusting gaseous and liquid fuel which during entry of combustion air is introduced into the burner interior space of the swirl generator and/or is introduced into the burner interior of the swirl generator on a burner axis, and also with a fuel lance which is arranged on the burner axis. The premix burner, in the transition section from the swirl generator to the mixer tube, includes at least one additional feed for introducing gaseous and/or liquid premix fuel from the wall region into the burner interior space of the mixer tube.

21 Claims, 15 Drawing Sheets

FOREIGN PATENT DOCUMENTS

| | | | |
|---|---|---|---|
| WO | 03056241 | A | 7/2003 |
| WO | 2005121648 | A | 12/2005 |
| WO | 2006058843 | A | 6/2006 |
| WO | 2006069861 | A | 7/2006 |

* cited by examiner

PREMIX BURNER FOR A GAS TURBINE

CROSS REFERENCE TO RELATED APPLICATION

This application is a continuation of International Application No. PCT/EP2008/065116 filed Nov. 7, 2008, which claims priority to Swiss Patent Application No. 01838/07, filed Nov. 27, 2007, the entire contents of all of which are incorporated by reference as if fully set forth.

FIELD OF INVENTION

The present invention refers to a premix burner with a swirl generator and a downstream mixer tube for combusting at least one fuel or for operation with one or more fuels, especially for use in a gas turbine. Furthermore, the present invention also refers to a method for operating such a premix burner.

BACKGROUND

Burners for combusting liquid and/or gaseous fuels, especially for use in a gas turbine, are known, which on the one hand have a high stability during operation, and on the other hand have good characteristics with regard to NOx values.

Thus, the so-called EV burner became known from EP-A1-321809. The premix burner which is described there is a conical burner which comprises a plurality of shells, a so-called double-cone burner, for creating a closed swirled flow in the cone head, which flow, on account of the increasing swirl along the cone point, becomes unstable and changes into an annular swirled flow with backflow in the core. Fuels, such as gaseous fuels, are injected along the passages which are formed by the individual adjacent shells, —also referred to as air inlet slots, and are homogeneously intermixed with air, before combustion commences as a result of ignition at the stagnation point of the backflow or backflow bubble, which fulfills the function of a device-free flame retainer. Liquid fuels are preferably injected via a central nozzle at the burner head and then evaporate in the cone cavity. A further important development in the field of premix burners involves the so-called AEV burner, as is known for example from EP-A1-704 657. The proposed burner has a swirl generator on the head side, which uses the aerodynamic basic principles of the EV burner which is already described above, for example according to EP-A1-0 321 809. This swirl generator is arranged upstream of a mixing section, the construction of which is explained in more detail further below. In principle, however, the use of an axial or radial swirl generator is also possible. Furthermore, it is also possible to provide a swirl generator which comprises a cylindrical or virtually cylindrical tube in which air flows into the inside of the tube via similar longitudinal slots, as in the case of the EV swirl generator, wherein the desired swirl formation of the air is carried out by means of a conically extending inner body for maximizing the sought-after premixing with a fuel which is injected at a suitable point, wherein this inner body conically tapers in the flow direction, with which the requirements for an efficient swirled flow are also provided in this case. Both the embodiments for the swirl generation which are referred to here, and the said printed publications, are an integrating element of this description. The mixing section itself preferably comprises a tubular mixing element, —subsequently referred to as a mixer tube, which permits a perfect premixing of the fuel, or fuels, which is or are used. The flow from the swirl generator in this case is transferred smoothly into the mixer tube. This takes place as a result of a transition geometry which comprises transfer passages which form the head part of this mixer tube, and which, as already indicated, transfer the flow into the adjoining effective throughflow cross section of the mixer tube. This loss-free, per se, flow guiding between swirl generator and mixer tube first of all prevents the direct formation of a backflow zone at the outlet of the swirl generator. Initially, the swirl intensity in the swirl generator is selected via its geometry so that the breaking up of the vortex does not take place in the mixer tube but further downstream at the combustion chamber inlet, wherein the length of this mixer tube is dimensioned so that a satisfactory mixing quality for all fuel types results. If, for example, the swirl generator which is used is constructed according to the principle features of the double-cone burner, then the swirl intensity results from the design of the corresponding cone angle, of the air inlet slots, and their number. In the mixer tube itself, the axial velocity profile has a distinct maximum on the axis and consequently prevents flashbacks in this region. The axial velocity decreases towards the wall. In order to also prevent flashbacks in this region, provision is made for various measures. For example, for one thing the overall velocity level can be raised by using a mixer tube with a sufficiently small diameter. Another possibility is to increase the velocity only in the outer region of the mixer tube by a small portion of the combustion air flowing into the mixer tube via an annular gap or through film layer holes downstream of the transfer passages.

Provision is frequently made in such burners for a plurality of fuel injection nozzles which are arranged in groups in order to thus ensure a stable combustion in different load ranges, for example special pilot nozzles for the low load range. In this case, the flame position can shift considerably, depending upon the piloting, and in such a case thermo-acoustic fluctuations can also occur in transition sections as a result of periodic change of the flame front positions.

These thermo-acoustic oscillations constitute a danger for each type of combustion application. They lead to pressure oscillations of high amplitude, to limitation of the operating range, and can increase pollutant emissions. This especially applies to combustion systems with low acoustic damping, such as annular combustion chambers with reverberative walls. In order to enable a high power conversion over a wide operating range with regard to pulsations and pollutant emissions, an active control of the combustion oscillations may be necessary.

In the prior art, as combustion concepts for partial load operation of such burners, for example so-called burner staging is known, in which individual burners are purposefully deactivated so that the remaining burners can be operated at full load. In particular, in the case of annular combustion chambers with a plurality of burner rings of different radius, which are offset in relation to each other, this concept can be used quite successfully.

As a result of fuel staging inside a burner, the flame position can be influenced and therefore influencing of flow instabilities and also time delay effects can be reduced (described for example in EP-A1-1 292 795).

It is also known to provide so-called pilot lances in such burners. Pilot fuel (gaseous or liquid) can be specifically fed centrally via a lance for the piloted operation of the burner, as is described for example in EP-A1-0 778 445 for the case of a double-cone burner, and in WO-A-93/17279 and also in EP-A1-0 833 105 for premix burners without, or with, a downstream mixing section.

SUMMARY

The disclosure is directed to a burner for premix combustion. The burner includes a swirl generator and a downstream mixer tube for combusting at least one fuel. The fuel is introduced into a burner interior space of the swirl generator or of the mixer tube. In a transition section from the swirl generator to the mixer tube and/or downstream of the transition section, the burner further includes at least one additional feed for introducing at least one additional fuel into the mixer tube.

The disclosure is also directed to a method for operating the above burner, for a fuel staging for different operating states. The method includes operating, individually and/or in combination various feeds for introducing liquid and/or gaseous fuel in dependence upon the load, or upon the output which is to be generated and/or upon the combustion quality or combustion stability also with regard to pollutant emission.

BRIEF DESCRIPTION OF THE DRAWINGS

The invention is subsequently explained in more detail based on exemplary embodiments in conjunction with the drawings. The exemplary embodiments serve for illustration of the invention and are not to be consulted in a limiting manner in the interpretation of the subject of the protection, as is defined in the claims which are outlined at the end.

In the drawings.

DETAILED DESCRIPTION OF THE PREFERRED EMBODIMENTS

Introduction to the Embodiments

Figure 1:
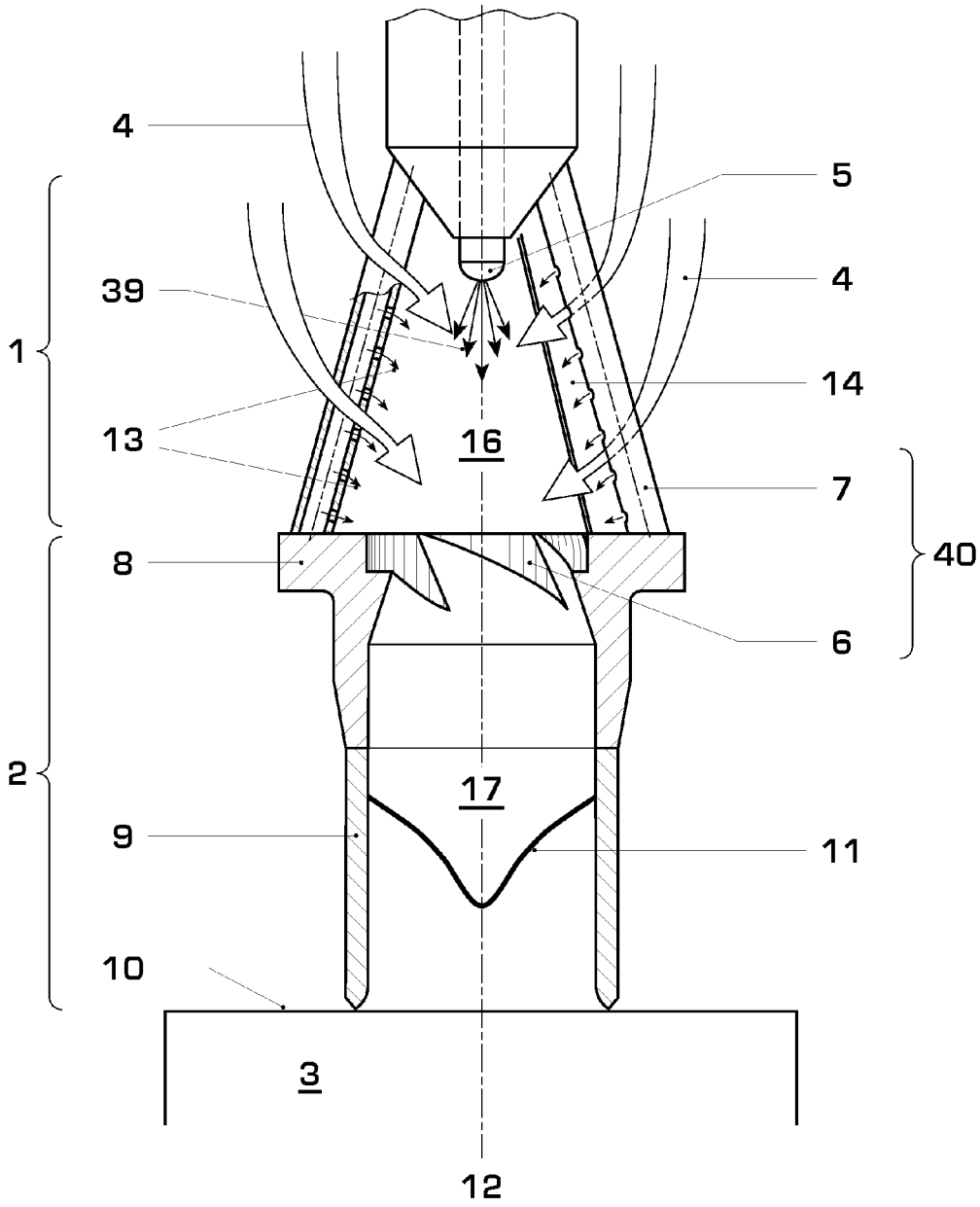
FIG. 1 shows an axial section through a premix burner with a downstream mixing section according to the prior art.

The premix burner, which is newly proposed here, is to overcome the disadvantages of the premix burner according to the prior art which are referred to in the introduction and especially to enable the combustion process to be made adjustable to the most diverse conditions, that is to say with regard to the applied load, the combustion stability, the combustion quality, the operating temperatures, etc.

In particular, it is a question of improving a premix burner with a swirl generator and a downstream mixer tube for combusting gaseous and/or liquid fuel. In this case, it preferably involves a premix burner in which the typically gaseous fuel can be introduced into the burner interior space of the swirl generator during entry of the combustion air and/or the liquid fuel can be introduced on a burner axis into the burner interior space of the swirl generator via a central fuel nozzle.

The burner, moreover, preferably has a fuel lance which is arranged on the burner axis.

The increased flexibility with regard to possible modes of operation is achieved by provision being made in the transition section from the swirl generator to the mixer tube for at least one additional feed for introducing gaseous and/or liquid premix fuel from the wall region into burner interior space of the mixer tube. In other words, it is a question of providing distribution lines for fuel and also discharge openings for the fuel, which are connected to these, in the region of the transition between swirl generator and mixing section, if necessary extending into the mixing section by up to 50% of the length of this in the flow direction. A region which can also include the last 20 to 30% of the length of the swirl generator and normally reaches into the mixer tube by 20 to 30% of the length of this, is in other words to be understood as a transition section between these two sections in this case. As a result of these additional feeds, a finely determinable fuel staging, which can also be adjusted to the widest variety of operating conditions, can be very flexibly realized in a very efficient manner. This is preferred both for operation with liquid fuel and with gaseous fuel. Either natural gas or synthesis gas or also liquid fuel (for example crude oil) can be fed through these feeds.

According to a first preferred embodiment, the premix burner includes a fuel lance which is arranged on the burner axis and extends at least partially right into the mixer tube, preferably in the region of 40-60% of the length of this. This fuel lance in this case serves on the one hand for introducing pilot fuel in the region of the outlet of the mixing section, and on the other hand the fuel lance serves for modifying and for stabilizing the internal recirculation zone, this not only because of its presence but also as a result of means which are arranged in the fuel lance for introducing fuel and, if applicable, also air.

According to a particular embodiment of such a fuel lance, this is designed in such a way that both liquid and gaseous fuel can be introduced into the burner interior space of the mixer tube via the fuel lance. This increases the flexibility with regard to the possible fuels.

The fuel lance is advantageously developed in such a way that at the tip of the fuel lance both liquid pilot fuel and gaseous pilot fuel can be introduced into the burner interior space of the mixer tube. In this case, the injection of liquid fuel is preferably carried out centrally. This means that the liquid pilot fuel can preferably be introduced via at least one opening or fuel nozzle which is arranged essentially on the burner axis. Furthermore, the gaseous pilot fuel is preferably introduced via a multiplicity (for example a complete ring) of radially outwardly offset openings at the tip the fuel lance. The corresponding nozzles both for the liquid fuel and for the gaseous fuel can preferably be set with regard to the introduction direction or to the distribution action for the fuel so that an optimum intermixing with the combustion airflow is established for the different staging conditions.

The fuel lance is preferably also an aid for the actual staging inside the burner. For this purpose, according to a further preferred embodiment the fuel lance is designed in such a way that liquid premix fuel can be introduced in the transition section into the burner interior space in the radial direction, that is to say radially outwards, wherein an axial component in the flow direction, or an injection direction which is adapted to the swirl, is also possible. For this purpose, different rows or groups of openings, which are arranged one behind the other in the flow direction, are preferably available along the fuel lance, and these rows can be operated separately with liquid fuel. If not only one such row is available but a plurality of rows, which are connected one behind the other in the flow direction, are available, the openings of different rows or groups are preferably arranged in a offset manner in the flow direction. This means the injection openings are not only offset in the axial direction (different groups) but openings of different groups are preferably not arranged one behind the other in the flow direction so that during normal operating conditions the fuel of an opening which is located upstream "impinges" directly upon the fuel of an opening which is located downstream. In this way, an optimum intermixing with the combustion air can be achieved since the individual fuel columns of individual openings are accurately guided next to each other to the desired degree. In this case, consideration is to be given to the fact that the combustion airflow is subjected to a swirl, that is to say offset with regard to the normal rotating combustion airflow is inter alia also to be understood by offset.

In a further preferred embodiment, the fuel lance is formed in such a way that gaseous premix fuel can be introduced in the transition section into the burner interior space in the radial direction, wherein different rows or groups of openings, which are arranged one behind the other in the flow direction, are preferably available along the fuel lance, and these rows can be operated separately with gaseous fuel, and wherein the openings of different rows or groups are especially preferably arranged in an offset manner in the flow direction.

The fuel lance preferably has both such groups for liquid fuel and such groups for gaseous fuel.

In respect to construction, the above can be realized for example by the fuel lance being formed from at least one outer tube with an inner coaxially arranged inner tube and/or with radially extending partitioning walls for the separately controllable feed of liquid or gaseous fuel as pilot fuel to the tip of the fuel lance and/or as premix fuel for introduction in the transition section.

In the transition section, especially preferably in the region of transfer passages which are arranged there, a feed for liquid fuel is arranged according to a further preferred embodiment of the invention. This feed preferably has at least one row of discharge openings for liquid fuel, wherein provision is especially made for at least one row of discharge openings which are arranged essentially at the same level in the flow direction. In this case, with the presence of a plurality of such rows of discharge openings, these can preferably be operated separately (if necessary, groups of discharge openings can also be operated separately). Furthermore, these openings are preferably arranged in an offset manner in the flow direction and/or are formed in different sizes. With regard to the injection direction, the openings are preferably set so that especially the wall regions are not impinged upon by fuel, and that the desired intermixing or separate forming of fuel columns inside the mixing section accurately results.

In a further preferred embodiment, in the transition section, especially preferably in the region of, or directly downstream of, transfer passages which are arranged there, at least one feed for gaseous fuel is arranged, wherein this feed preferably introduces gaseous fuel via at least one row of discharge openings. In this case, also in the case of gaseous fuel, it is preferred if provision is made for at least one row of discharge openings which are arranged essentially at the same level in the flow direction, and wherein with the presence of a plurality of such rows of discharge openings these can be especially preferably operated separately, and/or are arranged in an offset manner in the flow direction, and/or are formed in different sizes and/or with regard to the injection direction are set so that especially the wall regions are not undesirably impinged upon by fuel.

The at least one feed typically comprises at least one at least partially encompassing distribution line which is operated via a controllable feed with fuel.

In general, in the case of the swirl generator it preferably involves a double-cone burner or a multiple-cone burner which has two partial cone bodies, or a multiplicity of partial cone bodies, which are offset in relation to each other in such a way that the combustion air enters the burner interior space of the swirl generator through tangential air inlet slots which formed in the process, wherein liquid fuel can be introduced via a central fuel nozzle and/or gaseous fuel can be introduced at the said air inlet slots. In the case of the swirl generator, therefore, it preferably involves a construction as is described in EP-A1-0 321 809, which is incorporated by reference herein as if fully set forth. Accordingly, the disclosure content of EP-A1-0 321 809, with regard to the type of construction of the swirl generator, is expressly included in the disclosure content of the present documentation.

Furthermore, in a transition section between swirl generator and mixer tube, transfer passages, for transferring a flow which is formed in the swirl generator into the throughflow cross section of the mixer tube which is connected downstream of the transfer passages, are generally preferably arranged. In the case of the mixing section, therefore, it preferably involves a mixing section as is described in EP-A1-0 704 657, and its disclosure content, with regard to the type of construction of the mixing section or its connection to the swirl generator, is also expressly included in this disclosure.

Furthermore, the present invention refers to a method for operating a premix burner, as was described above. The method is especially directed to a fuel staging for different operating conditions described above for introducing liquid and/or gaseous fuel in the wall region and/or via the fuel lance in dependence upon the load or upon the output which is to be generated and/or upon the combustion quality or combustion stability, especially also with regard to pollutant emission, are operated individually and/or in combination.

In a first preferred embodiment of the method at least two different stages for operation with gaseous and/or liquid fuel are used, using at least two feeds which are arranged one behind the other in the flow direction, or using at least one feed in the transition section via a fuel lance and at least one feed in the transition section from the wall region into the burner interior space. In addition, gaseous and/or liquid pilot fuel can be introduced into the combustion airflow via the tip of the fuel lance. In general, natural gas and/or synthesis gas and/or crude oil can be used as fuel.

Further preferred embodiments are described in the dependent claims.

DETAILED DESCRIPTION

FIG. 1 shows a so-called AEV burner, as is described in EP-A1-0 704 657, mentioned above. Such a premix burner comprises a swirl generator 1 and a mixer tube 2 (also referred to as mixing section) which is arranged downstream of it. Such a burner adjoins a combustion chamber 3, into the back wall of which the burners are normally let in by a burner front element 10.

The swirl generator in this case is basically formed as is described in EP-A1-0 321 809. The swirl generator 1 in other words comprises two partial cone bodies 14 which are displaced in relation to each other. Due to the displacement of these partial cone bodies 14, a tangential air inlet slot 7 results on both sides in each case between these two partial cone bodies. The burner interior space 16 of the swirl generator is formed inside the two partial cone bodies 14. Combustion air 4 enters the burner interior space 16 through these tangential air inlet slots 7 and forms a rotating and forwards advancing, swirl-affected combustion airflow.

Into this combustion airflow, on the one hand liquid fuel can be introduced, essentially on the burner axis 12, via a central fuel nozzle 5 for liquid fuel 39. Alternatively, it is possible to introduce gaseous fuel in the region of the tangential air inlet slots 7. For this, provision is normally made in the tangential air inlet slots 7, and extending parallel to these, for lines for gaseous fuel, which via a plurality of openings which are distributed along the air inlet slots introduce the gaseous fuel 13 into the combustion airflow 4 at the moment of its entry into the burner interior space 16.

The mixer tube 2 is arranged downstream of this swirl generator 1. There is a transition section 40 between the mixer tube and swirl generator. In this transition section, with the aid of transfer passages, it is ensured that an optimum entry of the swirl-affected airflow from the burner interior space 16 of the swirl generator 1 into the burner interior space 17 of the mixing section is carried out. In this case, it involves guide elements as are described for example in EP-A1-0 704 657. The transfer passages are arranged in a transition piece 8.

A tube section 9 adjoins this transition piece 8 downstream, and the burner front element 10 is connected on the end of the burner front in order to ensure the transition to the actual combustion chamber. In FIG. 1, the velocity profile 11 in the axial direction is also shown, and it is apparent that there is a maximum velocity in the axial direction on the burner axis 12.

In conjunction with such a type of burner construction, a structure is now to be made available which allows a staged mode of operation (staging) which enables the burner to be able to be constantly optimally operated under the most diverse conditions. For this, provision is made for additional possibilities for introducing gaseous fuel or liquid fuel and also for a central fuel lance in addition.

Figure 2:
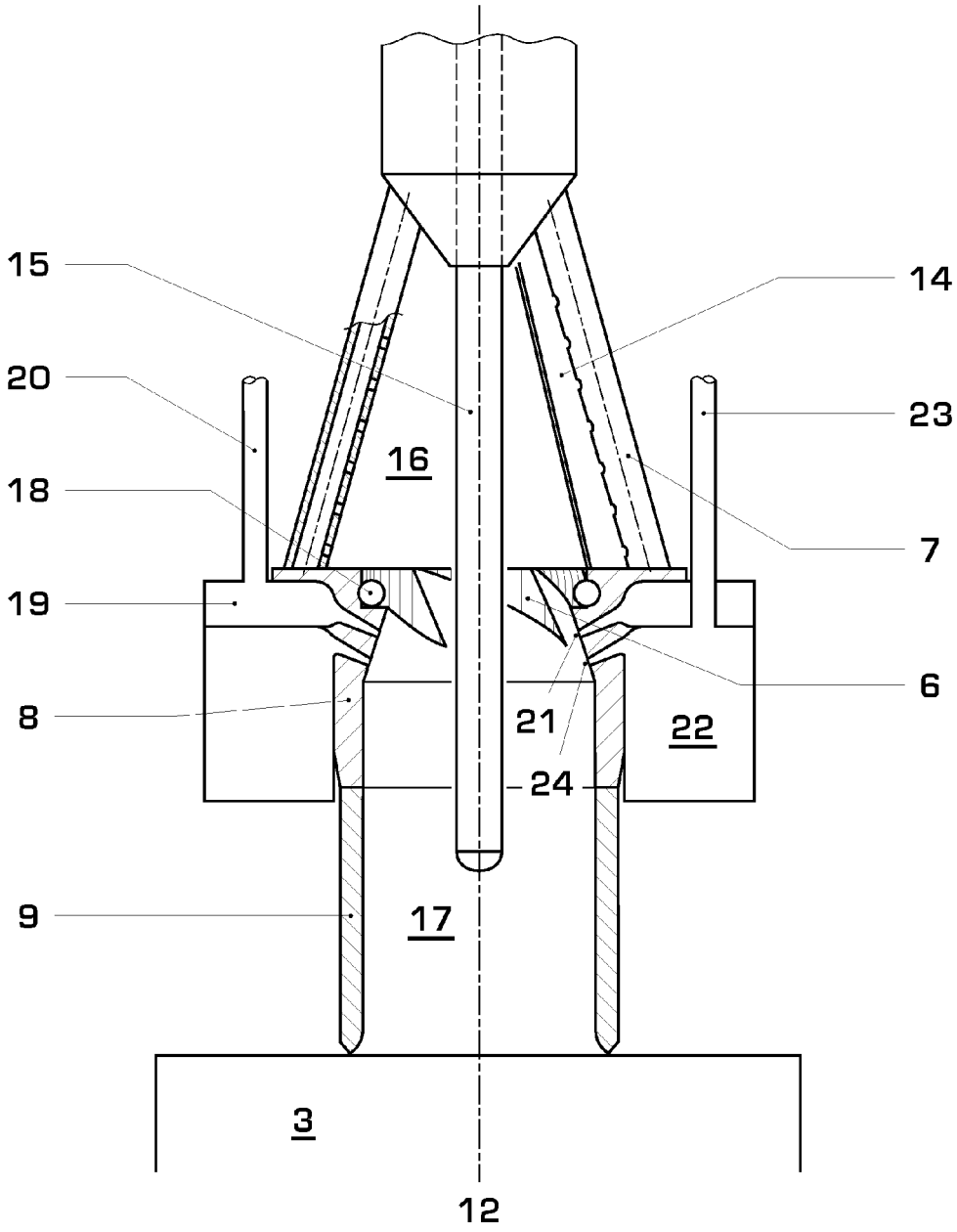
FIG. 2 shows an axial section through a premix burner with a downstream mixing section with a long fuel lance and with additional feeds of liquid fuel and gaseous fuel which are arranged in the transition section.

The principle components of the proposed modified AEV burner are shown in FIG. 2. On the one hand, a central fuel lance 15 is provided on the burner axis 12. This fuel lance 15 extends through the swirl generator 1 and far into the mixer tube 2. That is to say it involves an exceptionally long fuel lance, the fuel lances in conjunction with a burner with a downstream mixing section, which are proposed according to the prior art, normally extending only over the length of the swirl generator.

This fuel lance on the one hand provides the possibility of introducing gaseous fuel and also on the other hand the possibility of introducing liquid fuel. On the one hand, in the case of this fuel lance 15 pilot nozzles are arranged at its tip, at least one central pilot nozzle are provided for introducing liquid pilot fuel, and a multiplicity or a ring of nozzles are also arranged at the tip for introducing gaseous fuel (cf. description further below). Furthermore, the fuel lance 15 has discharge openings for liquid and gaseous fuel which are arranged in its middle section. In this case, a plurality of groups of openings for liquid fuel are advantageously arranged one behind the other in the flow direction, wherein these groups can be operated separately. Similarly, such groups for gaseous fuel are available. These nozzles or openings for introducing the fuel, which are described in greater detail further below, are advantageously arranged in a middle section of the fuel lance, that is to say in the transition section 40 between the swirl generator 1 and the mixer tube 2.

A feed 18 for liquid fuel is arranged next to the fuel lance. In this case it involves an encompassing fuel line for liquid fuel which is embedded in the transition piece 8 and which has a multiplicity of openings, which are distributed around the circumference, for introducing liquid fuel. In this case, as in the case of the fuel lance, different groups of such openings can be accurately arranged one behind the other in the flow direction. These openings, in other words, are arranged in an offset manner in the flow direction. So that the fuel columns which are discharged and formed from these openings do not cross paths in the case of the different groups which are connected one behind the other, the openings of different groups are also arranged in a offset manner in the circumferential direction.

Slightly further downstream, provision is made for a first external feed for gaseous fuel, normally natural gas. This feed 19 is carried out via a feed line 20 and is also formed as an encompassing passage which has discharge openings 21 for the gaseous fuel, which lead into the transition section 40.

Furthermore, provision is made for a second external feed for gaseous fuel 22 which in its turn is supplied with gaseous fuel via a fuel feed line 23. Also in this case, provision is made for an encompassing passage for the gaseous fuel (for example synthesis gas), and this encompassing passage leads into the burner interior space 17 via a multiplicity of discharge openings 24 which are distributed on the circumference.

The two groups of openings 21 and 24 in this case also are advantageously arranged in an offset manner, specifically in the circumferential direction so that the fuel columns of these two groups do not overlap in an undesirable manner.

Furthermore, in the case of the discharge openings both for gaseous fuel as well as for liquid fuel, the injection angle can generally be selected so that as far as possible no contact of the fuel with the wall takes place directly downstream of the openings in the flow direction and the continuous purging of fuel lines which are not in operation can be correspondingly avoided, and the risk of flashbacks can be eliminated.

Different operating possibilities of such a burner are to be subsequently explained with reference to FIGS. 3 to 15.

Figure 3:
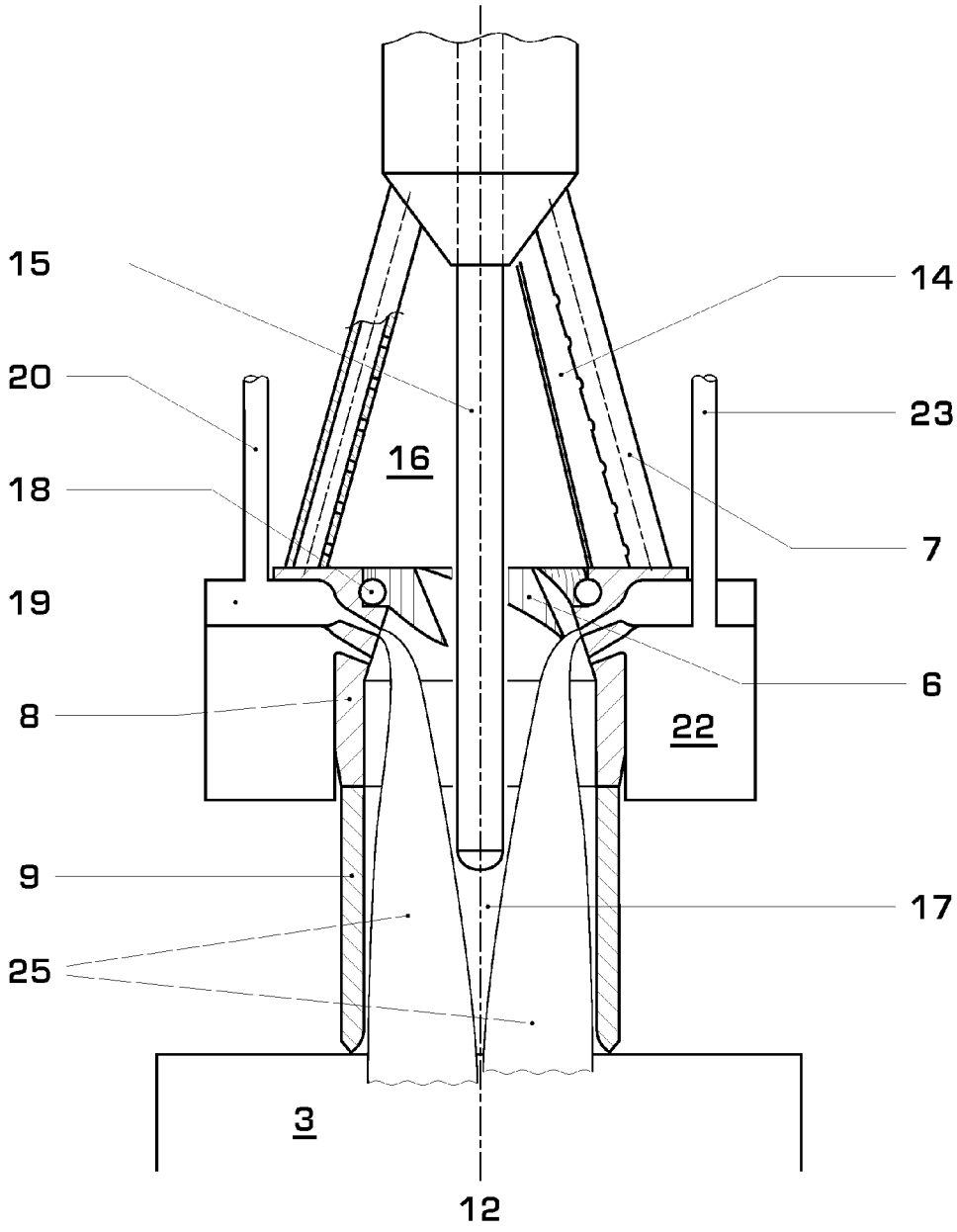
FIG. 3 shows an axial section through a premix burner with a downstream mixing section according to FIG. 2, in which premix gas is introduced from the first feed for gaseous fuel.

FIG. 3 shows a mode of operation with gas in the premix mode, using the external injectors of the first external fuel system 19. It is apparent here how in the mixing section a number of gaseous fuel columns 25, which corresponds to the number of discharge openings 21, are formed, which successively intermix and propagate with the combustion air flow.

Figure 4:
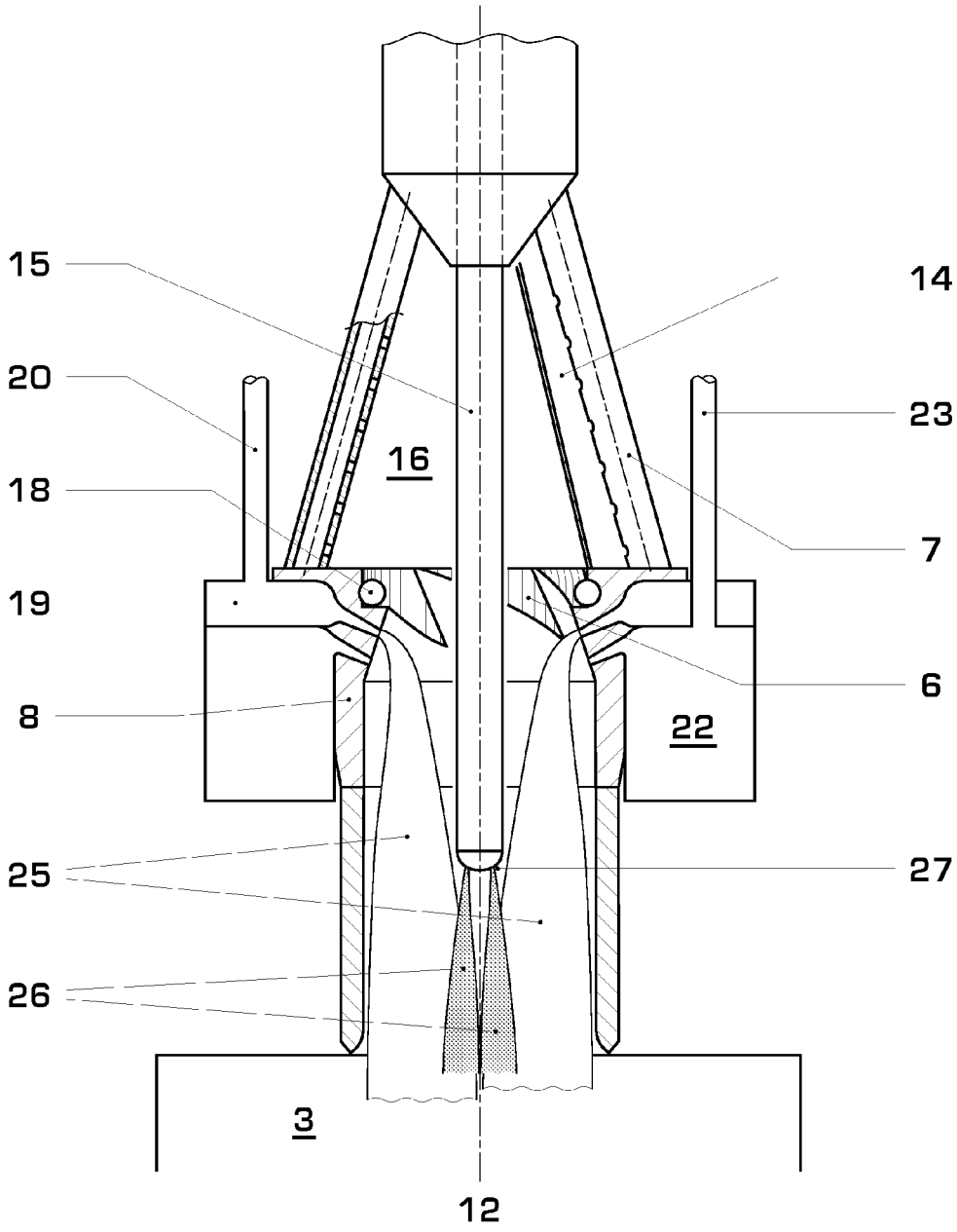
FIG. 4 shows an axial section through a premix burner with a downstream mixing section according to FIG. 2, in which premix gas is introduced from the first feed for gaseous fuel and also at the same time pilot gas is introduced via the tip of the fuel lance.

In FIG. 4, it is shown how in the case of such a mode of operation according to FIG. 3 pilot gas can additionally be introduced via the tip of the fuel lance. The pilot gas is introduced via pilot gas openings 27 and in its turn forms pilot-gas fuel columns 26.

Figure 5:
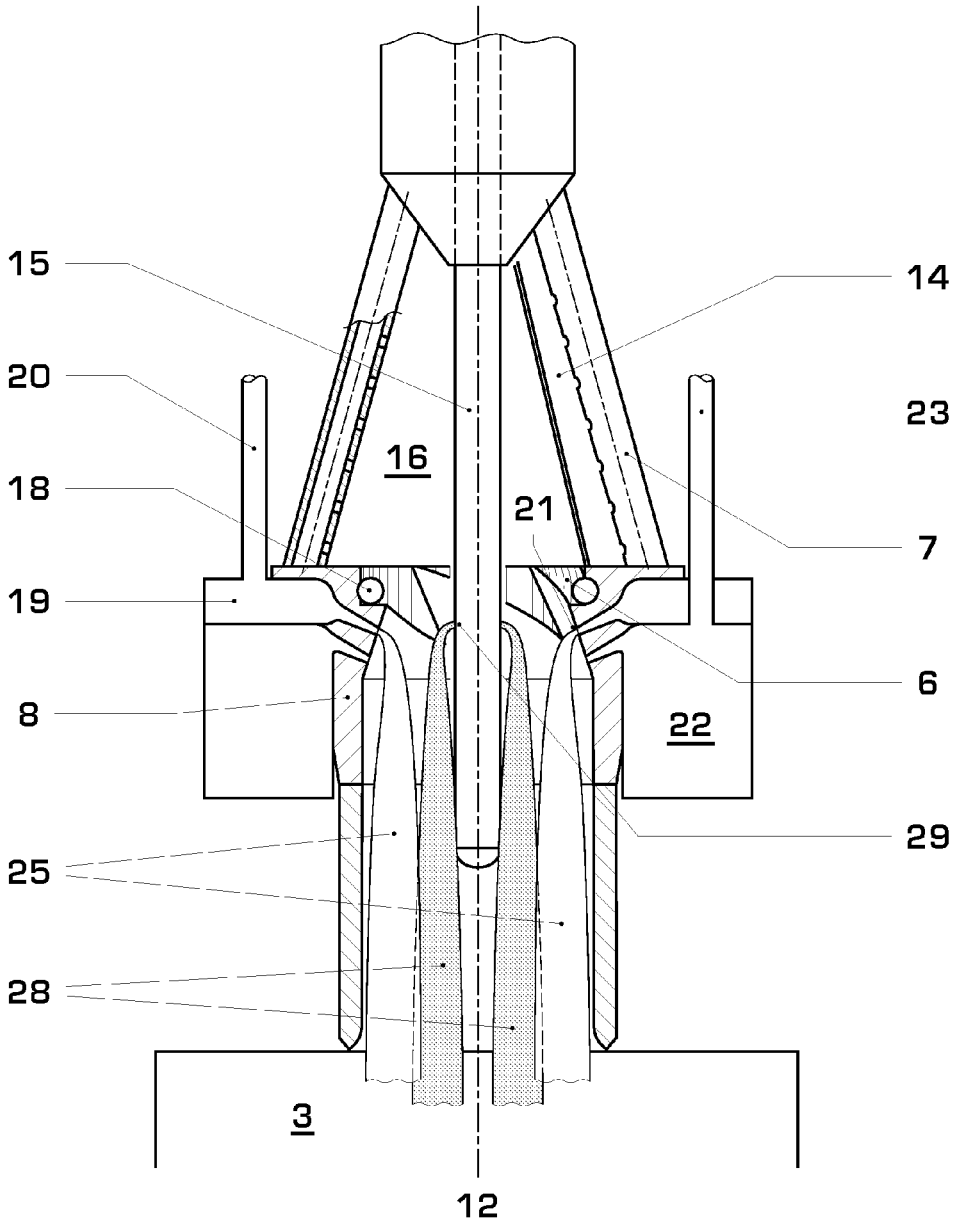
FIG. 5 shows an axial section through a premix burner with a downstream mixing section according to FIG. 2, in which premix gas is introduced from the first feed for gaseous fuel and also from a middle section of the fuel lance.

In FIG. 5, it is shown how in addition to introducing premix gas via the system 19, which is shown in FIG. 3, further premix gas can be introduced via the fuel lance. For this purpose, the fuel lance has premix gas openings 29 which are arranged in the transition section 40. These premix gas openings are distributed over the circumference of the outer wall of the fuel lance 15 and form a number of fuel columns which corresponds to the number of these openings 29. The openings 29 and 21 are preferably also offset in the circumferential direction so that the fuel columns 28 and 25 do not negatively overlap.

Figure 6:
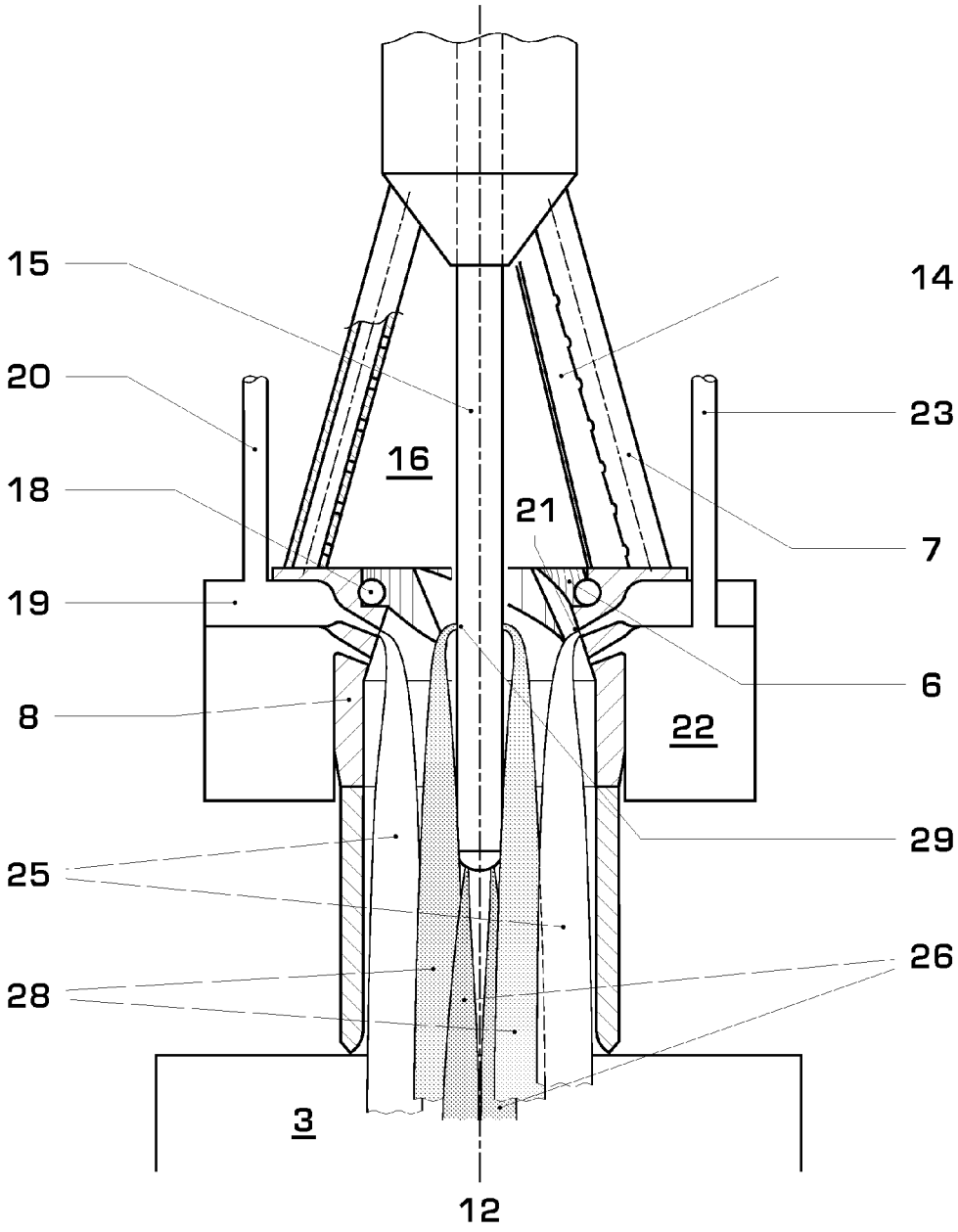
FIG. 6 shows an axial section through a premix burner with a downstream mixing section according to FIG. 2, in which premix gas is introduced from the first feed for gaseous fuel and from a middle section of the fuel lance, and also at the same time pilot gas is fed via the tip of the fuel lance.

In FIG. 6, it is shown, in a further variant of the mode of operation, how introducing gaseous fuel via the lance, forming the fuel columns 28, and introducing fuel via the system 19, forming the fuel columns 25, can be combined with introducing pilot fuel via the tip of the fuel lance 15, forming the fuel columns 26.

Figure 7:
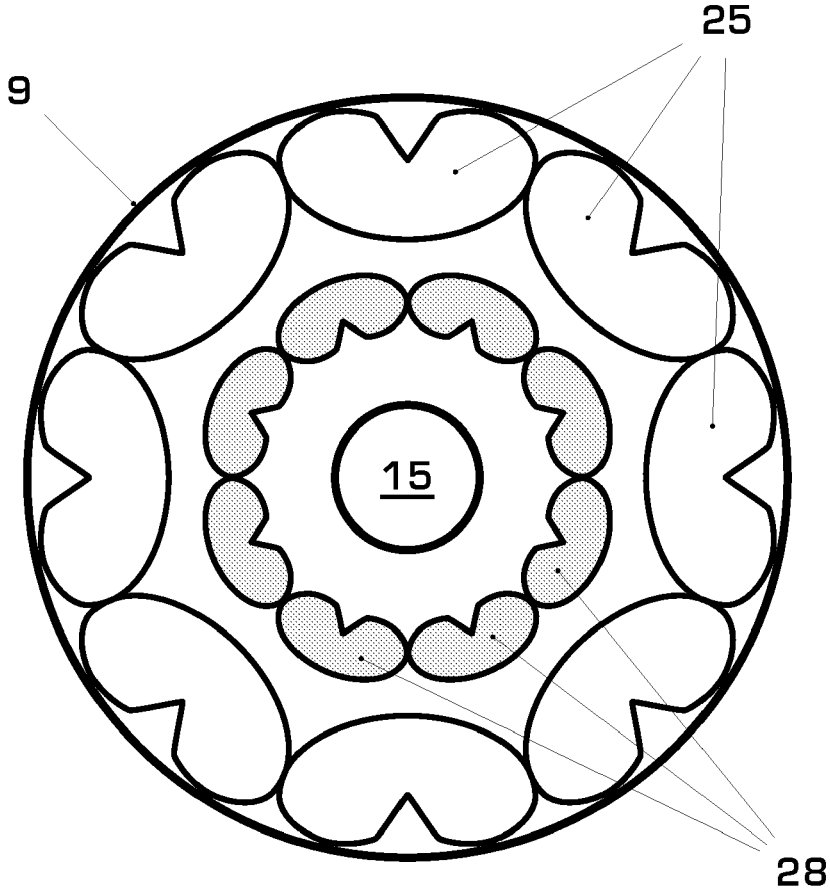
FIG. 7 shows a section perpendicular to the burner axis in the mixer tube for an operation according to FIG. 5.

In FIG. 7, in a section perpendicular to the burner axis through the mixing section, it is shown how the individual fuel columns 25 and 28 are formed. In this case, it can be seen that the fuel columns of the two groups 25 and 28 are arranged in an offset manner in each case, and that in this case each group forms eight fuel columns, that is to say both in the case of the system 19 as well as in the system on the fuel lance there are eight openings which are arranged in a uniformly distributed manner around the circumference. Furthermore, it can be seen how in this case the openings in system 19 are formed larger and in the system 19 a greater mass flow of gaseous fuel is established so that more substantial fuel columns are formed.

Figure 8:
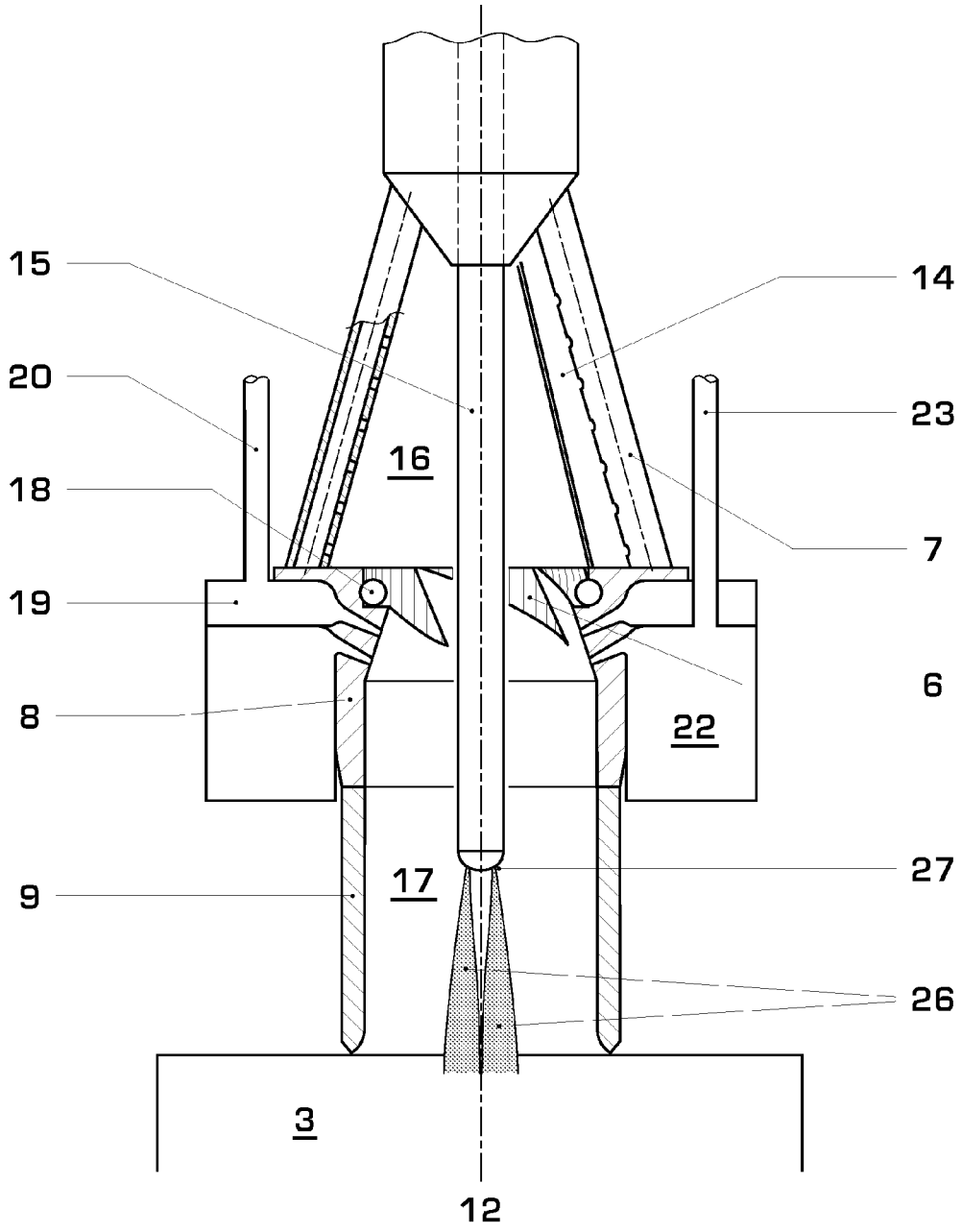
FIG. 8 shows an axial section through a premix burner with a downstream mixing section according to FIG. 2, in which pilot gas is introduced via the tip of the fuel lance.

In FIG. 8, for the sake of completeness, it is shown how such a burner can also be operated solely by operating the pilot nozzles 27 for gaseous fuel, forming the fuel columns 26. Furthermore, it should be stressed that another gaseous fuel can also be fed in the region of the inlet slots, if this should be desired.

Thus, it is apparent that for operation with gaseous fuel provision can be made for the most diverse stages of burner control, which enables a very flexible operation.

Figure 9:
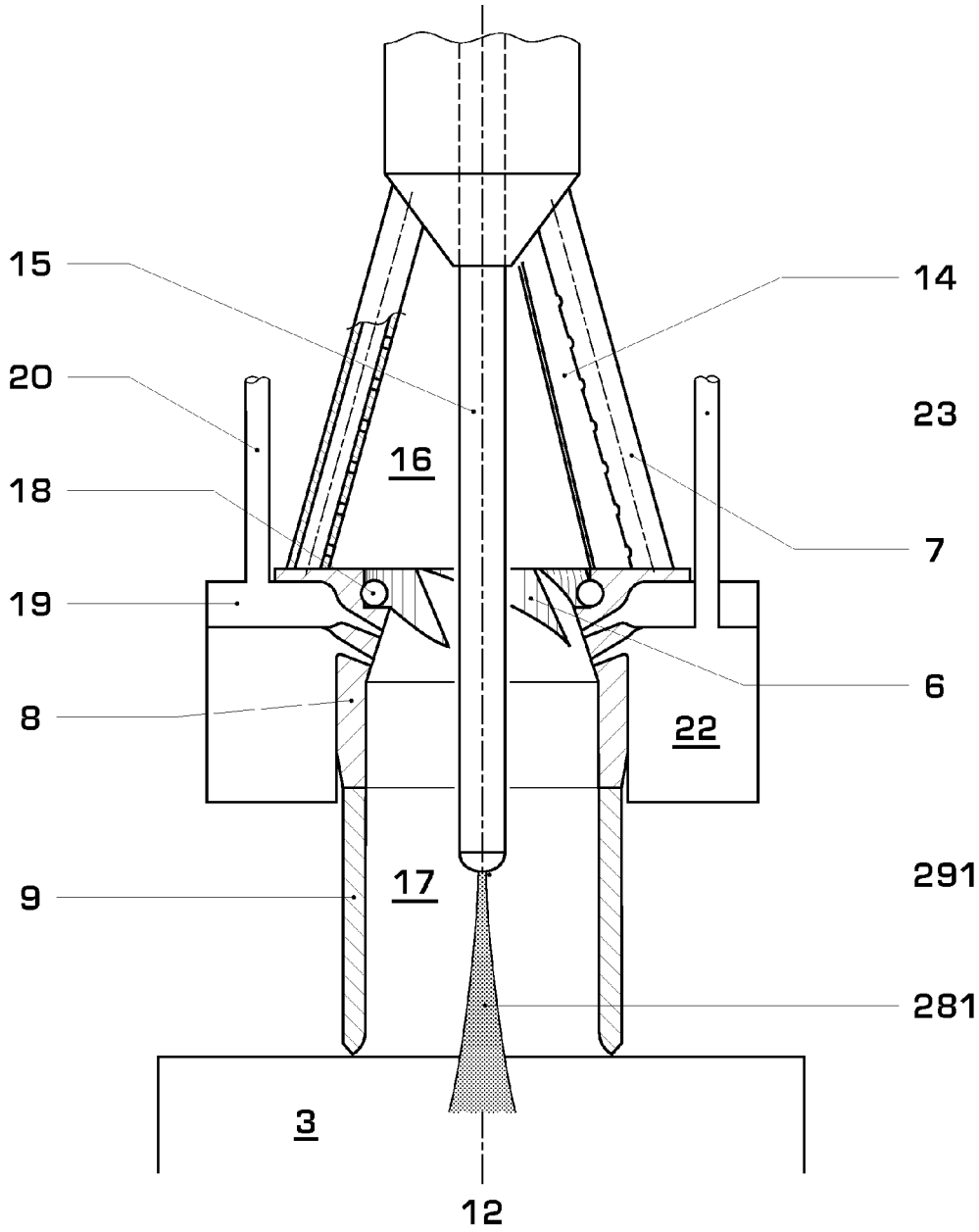
FIG. 9 shows an axial section through a premix burner with a downstream mixing section according to FIG. 2, in which liquid pilot fuel is introduced via the tip of the fuel lance.

In FIG. 9, the mode of operation with liquid fuel is now shown, wherein in this case only pilot fuel is introduced centrally via an opening 291 in the tip of the fuel lance 15 so that a single central fuel column 281 is formed.

Figure 10:
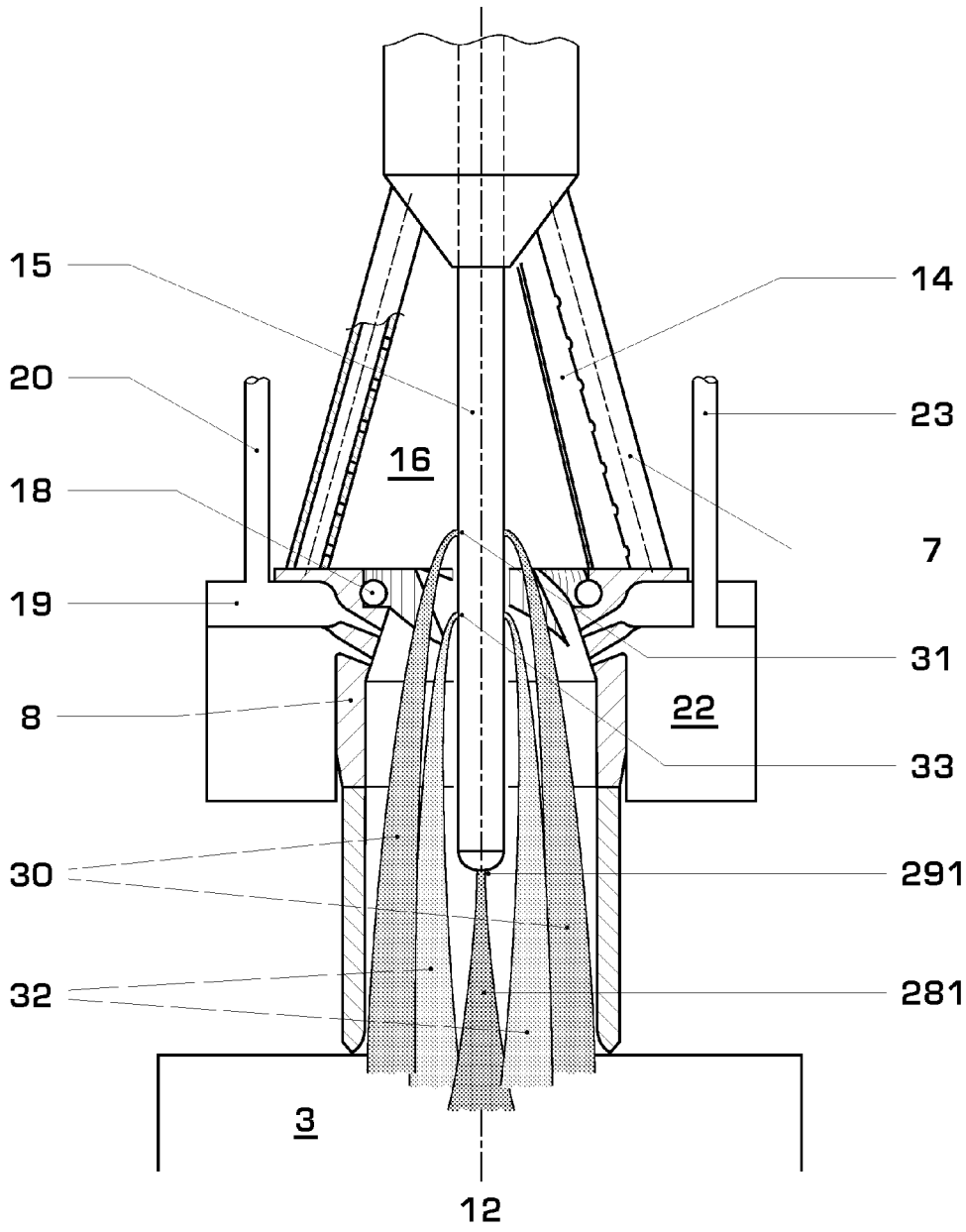
FIG. 10 shows an axial section through a premix burner with a downstream mixing section according to FIG. 2, in which liquid pilot fuel is introduced via the tip of the fuel lance and also at the same time liquid premix fuel is introduced via the central fuel lance from two different stages.

Such a mode of operation, as is shown in FIG. 10, can be combined with introducing liquid premix fuel via two groups of openings in the fuel lance. In this case, there is a first row 31, which is arranged upstream, of discharge openings for premix fuel in the middle section of the fuel lance. Furthermore, there is a second row 33 which is arranged slightly further downstream. The openings of these two rows are also arranged in an offset manner in the circumferential direction and the first row of openings 31 leads to the forming of fuel columns 30. The second row 33 is for the forming of fuel columns 32.

Figure 11:
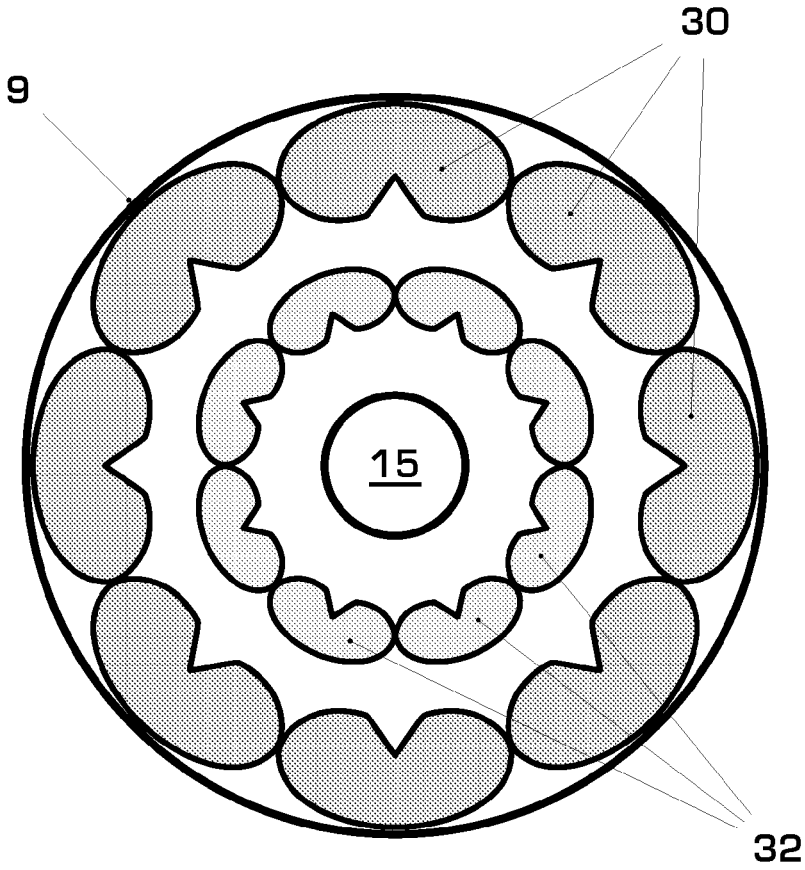
FIG. 11 shows a section perpendicular to the burner axis in the mixer tube for an operation according to FIG. 10, but without feed of liquid pilot fuel via the tip of the fuel lance.

As is apparent from a section perpendicular to the burner axis 12 according to FIG. 11, in the case of this mode of operation a distribution of the fuel columns, or fuel trajectories, is established, which again reflects the offset openings 31 and 33 and which makes it apparent that in this case the openings 31 are formed larger, or are operated with a larger mass flow, so that more substantial fuel columns 30 are formed.

Figure 12:
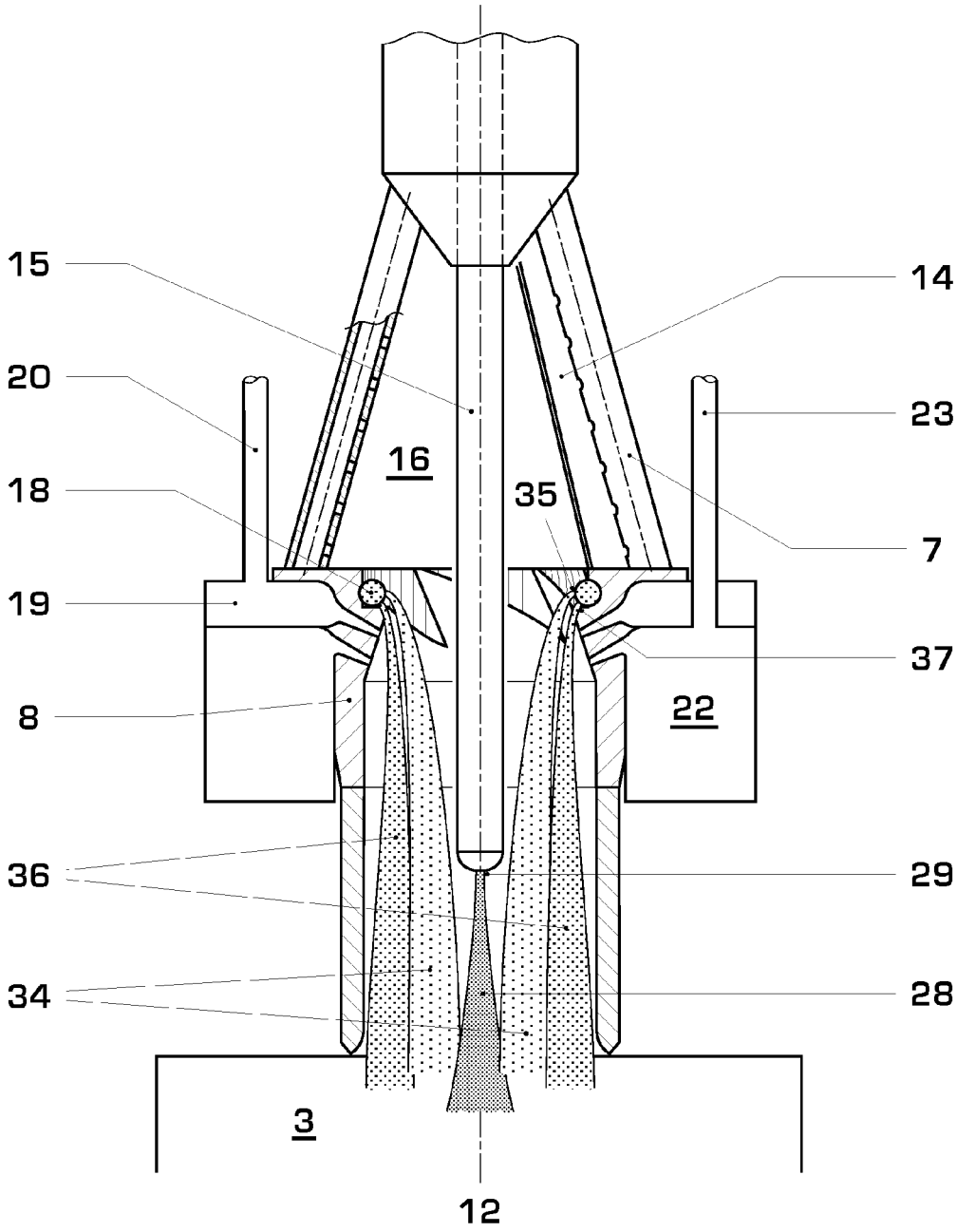
FIG. 12 shows an axial section through a premix burner with a downstream mixing section according to FIG. 2, in which liquid pilot fuel is introduced via the tip of the fuel lance and also at the same time liquid premix fuel is introduced via an external feed from two different stages.

In FIG. 12, a mode of operation with liquid fuel is also shown. In this case, however, the liquid fuel is now fed via the system 18. For this, the system 18 in the transition section 40 also has two groups of openings which are distributed over the circumference. A first group of openings is arranged further upstream and forms the group 35 of openings. A second group of openings 37, which in this case is fed via the same line, is arranged slightly further downstream. Also in this case, the openings 35 and 37 are arranged in an offset manner in the circumferential direction. The openings 35 are formed larger than the openings 37, and in this case the number of openings of the two groups 35 and 37 is not equal either.

Figure 13:
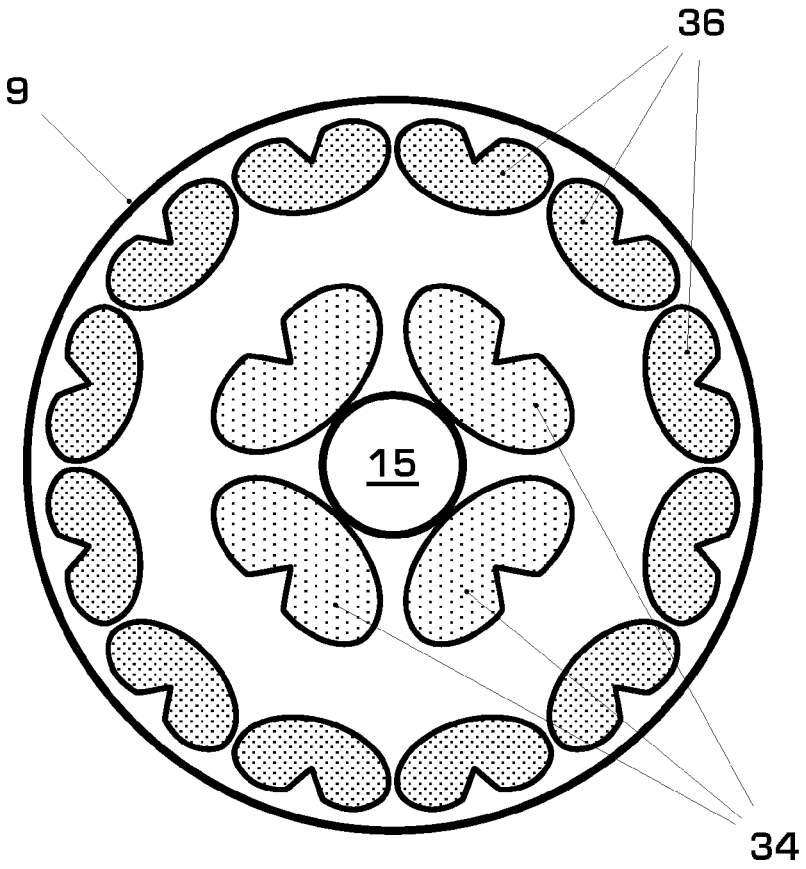
FIG. 13 shows a section perpendicular to the burner axis in the mixer tube for an operation according to FIG. 12, but without feed of liquid pilot fuel via the tip of the fuel lance.

As is apparent from a section according to the FIG. 13, there are specifically now four openings 35 and twelve openings 37.

Figure 14:
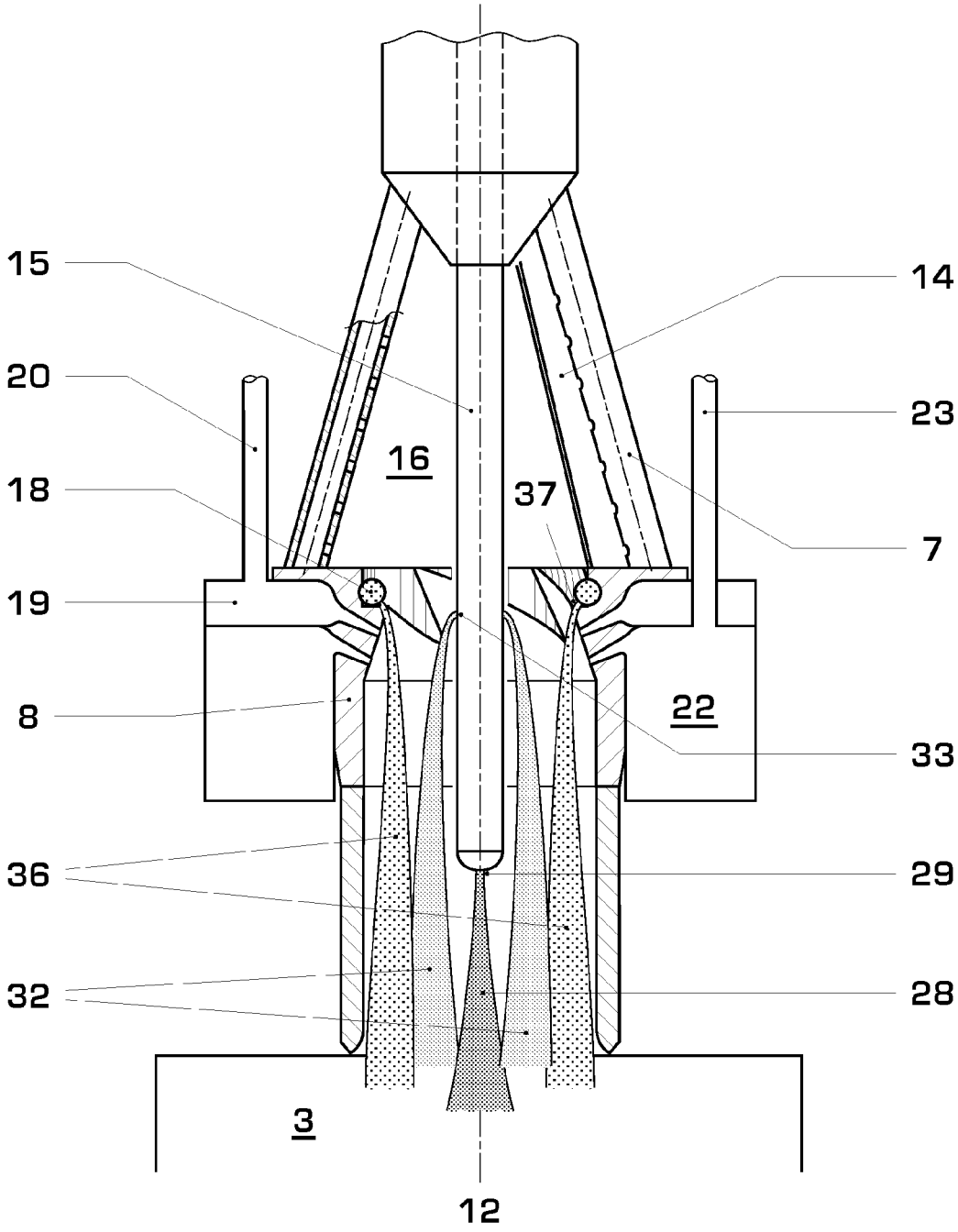
FIG. 14 shows an axial section through a premix burner with a downstream mixing section according to FIG. 2, in which liquid pilot fuel is introduced via the tip of the fuel lance and also at the same time liquid premix fuel is introduced via an external feed from one stage, and at the same time liquid premix fuel is introduced via the central fuel lance from one stage.

From FIG. 14, it is apparent that the modes of operation for liquid premix fuel, which are described further above, can also be operated in a combined manner by introduction via the fuel lance and via the system 18. Thus, it can be seen here that via the fuel lance, via a group of openings 33, a further multiplicity of fuel columns 32 are formed, in this case together with the introduction of pilot fuel 28, which is in addition to the introduction via the system 18, forming the columns 36.

Figure 15:
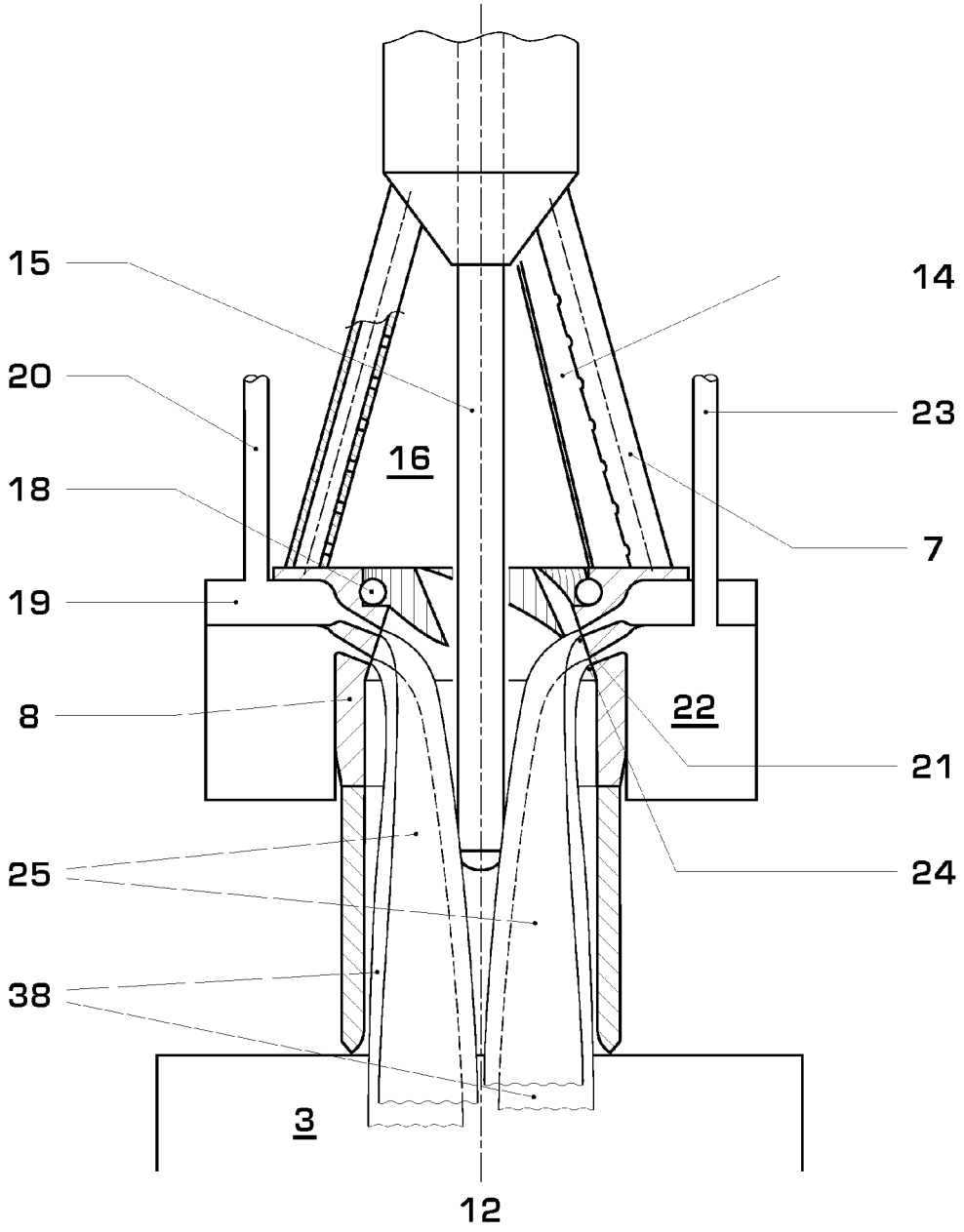
FIG. 15 shows an axial section through a premix burner with a downstream mixing section according to FIG. 2, in which gaseous premix fuel is introduced via the two external feeds.

Finally, FIG. 15 shows the possibility of using the two systems 19 and 22 for introducing gaseous fuel. In this case, the fuel columns 25, which are already described further above, are formed on account of the entry via the openings 21 of the system 19, and in addition the fuel columns 38 are formed as a result of the inlet openings 24 of the system 22. This mode of operation is especially suitable for example for synthesis gas.

The above modes of operation yield the following advantages:

The pilot gas and the liquid pilot fuel are directed to the central recirculation zone. As far as the quenching limit is concerned, this is the most efficient manner of piloting a burner.

As a result of the central piloting, no risk of overheating arises since the freely flowing enriched zone cannot impinge upon material surfaces.

Premix gas and oil can be apportioned to two different injectors which increases the intermixing (injection on two sides and offset for optimum penetration and mixing).

Increased resistance to flashback thanks to the absence of fuel on the axis and on the wall regions downstream of the transition piece.

Extremely flexible possibility of modification of the flow field and of the combustion stability with axial injection, which is orientated either with the flow or against the flow, at the tip of the fuel lance.

LIST OF DESIGNATIONS

1 Swirl generator
2 Mixer tube
3 Combustion chamber
4 Combustion air flow
5 Central fuel nozzle for liquid fuel
6 Transfer passages
7 Tangential air inlet slots
8 Sleeve ring with transition piece
9 Tube
10 Burner front element
11 Axial velocity distribution
12 Burner axis
13 Injection of gaseous fuel at 7
14 Partial cone body
15 Fuel lance
16 Burner interior space of swirl generator
17 Burner interior space of mixing section
18 Feed for liquid fuel
19 First external feed for gaseous fuel (for example natural gas or synthesis gas)
20 Feed line for 19
21 Discharge openings of 19
22 Second external feed for gaseous fuel (for example synthesis gas)
23 Feed line for 22
24 Discharge openings of 22
25 Premix gas flow from first external feed
26 Pilot gas from tip of 15
27 Pilot gas openings in tip of 15
28 Premix gas flow from middle section of 15
29 Premix gas openings in 15
281 Liquid pilot fuel from tip of 15
291 Opening(s) for liquid pilot fuel in tip of 15
30 Liquid premix fuel from first row of 15
31 First row of discharge openings for liquid premix fuel in middle section of 15
32 Liquid premix fuel from second row of 15
33 Second row of discharge openings for liquid premix fuel in the middle section of 15
34 Liquid premix fuel from first row of 18
35 First row of discharge openings for liquid premix fuel from 18
36 Liquid premix fuel from second row of 18
37 Second row of discharge openings for liquid premix fuel from 18
38 Premix gas flow from second external feed
39 Liquid fuel from 5
40 Transition section

What is claimed is:

1. A burner for premix combustion comprising a swirl generator (1) and a downstream mixer tube (2) for combusting at least one fuel (13, 39) which is introduced into a burner interior space (16, 17) of the swirl generator (1) or of the mixer tube (2), wherein in a transition section (6, 8, 40) from the swirl generator (1) to the mixer tube (2) and/or downstream of the transition section (6, 8, 40), the burner further comprises at least one additional feed (18, 19, 22) for introducing at least one additional fuel into the mixer tube (2), wherein in the transition section (6, 8, 40), in the region of, or directly downstream of, transfer passages (6) which are arranged there, at least one feed (19, 22) for gaseous fuel is arranged, said gaseous fuel feed introduces gaseous fuel via at least one row of discharge openings (21, 24), said feed introduces gaseous fuel via at least one row of discharge openings (21, 24), wherein at least one row of discharge openings (21, 24) are arranged essentially at the same level in the flow direction, said at least one row of discharge openings (21, 24) can be operated separately (20, 23), and/or are arranged in an offset manner in the flow direction and/or are formed in different sizes, and/or with regard to the injection direction are set so that the inner wall regions of the burner are not impinged upon by fuel.

2. The burner as claimed in claim 1, further comprising a fuel lance (15) which is arranged on the burner axis (12) of the burner.

3. The burner as claimed in claim 2, wherein the fuel lance (15) extends at least into the mixer tube (2).

4. The burner as claimed in claim 3, wherein the fuel lance (15) extends into the mixer tube in a region of 40-60% of a length of the mixer tube.

5. The burner as claimed in claim 2, wherein the fuel lance (15) is configured such that both liquid and gaseous fuel can be introduced into the burner interior space (17) of the mixer tube (2) via the fuel lance (15).

6. The burner as claimed in claim 2, wherein at a tip of the fuel lance (15) both liquid pilot fuel (281) and gaseous pilot fuel (26) can be introduced into the burner interior space (17) of the mixer tube (2), the liquid pilot fuel (281) can be introduced via at least one opening (291) which is generally arranged on the burner axis (12) and/or the gaseous pilot fuel (26) can be introduced via a multiplicity of radially outwardly offset openings (27) at the tip of the fuel lance (15).

7. The burner as claimed in claim 2, wherein the fuel lance (15) is configured such that liquid fuel (30, 32) can be introduced in the transition section (6, 8, 40) into the burner interior space (16, 17) in the radial direction, and different rows or groups of openings (31, 33), which are arranged one behind the other in the flow direction, are available along the fuel lance (15), the rows are operated separately with liquid fuel, and the openings (31, 33) of different rows or groups are arranged in an offset manner in the flow direction.

8. The burner as claimed in claim 2, wherein the fuel lance (15) is configured such that gaseous fuel (28) can be introduced in the transition section (6, 8, 40) into the burner interior space (16, 17) in the radial direction, and different rows or groups of openings (29), which are arranged one behind the other in the flow direction, are available along the fuel lance (15), the rows are operated separately with gaseous fuel, and the openings (29) of different rows or groups are arranged in an offset manner in the flow direction.

9. The burner as claimed in claim 2, wherein the fuel lance (15) comprises at least one outer tube with a coaxially arranged inner tube and/or with radially extending partitioning walls for a separately controllable feed of liquid or gaseous fuel as pilot fuel to a tip of the fuel lance (15) and/or as premix fuel for introduction in the transition section (6, 8, 40).

10. The burner as claimed in claim 1, wherein in the transition section (6, 8, 40), in the region of transfer passages (6) which are arranged there, a feed (18) for liquid fuel is arranged, wherein the liquid fuel feed introduces liquid fuel via at least one row of discharge openings (35, 37), wherein provision is made for at least one row of discharge openings (35, 37) which are arranged essentially at the same level in the flow direction, and wherein with the presence of a plurality of said rows of discharge openings (35, 37) can be operated separately, and/or are arranged in an offset manner in the flow direction and/or are formed in different sizes, and/or with regard to the injection direction are set so that the wall regions are not impinged upon by fuel.

11. The burner as claimed in claim 10, wherein the at least one feed (18, 19, 22) comprises at least one at least partially encompassing distribution line which is operated via a feed (20, 23) with fuel.

12. The burner as claimed in claim 1, wherein the swirl generator (1) comprises at least two hollow partial cone shells which are nested inside each other in the flow direction, completing a body, the cross section of the interior space which is formed by the hollow partial cone shells increases in the flow direction, the respective longitudinal symmetry axes of these partial cone shells extend in an offset manner in relation to each other in such a way that the adjacent walls of the partial cone shells in their longitudinal extent form tangential air inlet slots or passages for the inflow of combustion air into the interior space which is formed by the partial cone shells.

13. The burner as claimed in claim 12, wherein liquid fuel is introduced via a central fuel nozzle (5) and/or gaseous fuel (13) is introduced at said tangential air inlet slots.

14. The burner as claimed in claim 1, wherein the swirl generator (1) comprises at least two hollow partial shells which are nested inside each other in the flow direction, completing a body, the cross section of the interior space which is formed by the hollow partial shells extends in a cylindrical or virtually cylindrical manner in the flow direction, the respective longitudinal symmetry axes of these partial shells extend in an offset manner in relation to each other in such a way that the adjacent walls of the partial shells in a longitudinal extent form tangential air inlet slots or passages for the inflow of combustion air into the interior space which is formed by the partial shells, and the interior space has an inner body, the cross section of which reduces in the flow direction.

15. The burner as claimed in claim 14, wherein liquid fuel is introduced via a central fuel nozzle (5) and/or gaseous fuel (13) is introduced at said tangential air inlet slots.

16. The burner as claimed in claim 1, wherein in a transition section (40) between swirl generator (1) and mixer tube (2), the burner has transfer passages (6) for transferring a flow which is formed in the swirl generator (1) into the through-flow cross section of the mixer tube (2), which is connected downstream of the transfer passages.

17. The burner as claimed in claim 1, wherein the at least one feed (18, 19, 22) comprises at least one at least partially encompassing distribution line which is operated via a feed (20, 23) with fuel.

18. A method for operating a burner for premix combustion comprising a swirl generator (1) and a downstream mixer tube (2) for combusting at least one fuel (13, 39) which is introduced into a burner interior space (16, 17) of the swirl generator (1) or of the mixer tube (2), wherein in a transition section (6, 8, 40) from the swirl generator (1) to the mixer tube (2) and/or downstream of this transition section (6, 8, 40), the burner further comprises at least one additional feed (18, 19, 22) for introducing at least one additional fuel into the mixer tube (2), wherein in the transition section (6, 8, 40), in the region of, or directly downstream of, transfer passages (6) which are arranged there, at least one feed (19, 22) for gaseous fuel is arranged, said gaseous fuel feed introduces gaseous fuel via at least one row of discharge openings (21, 24), said feed introduces gaseous fuel via at least one row of discharge openings (21, 24), wherein at least one row of discharge openings (21, 24) are arranged essentially at the same level in the flow direction, said at least one row of discharge openings (21, 24) can be operated separately (20, 23), and/or are arranged in an offset manner in the flow direction and/or are formed in different sizes, and/or with regard to the injection direction are set so that the inner wall regions of the burner are not impinged upon by fuel, the method comprising:

operating, individually and/or in combination, for a fuel staging for different operating states, various feeds (18, 19, 22, 27, 29, 291, 31, 33, 35, 37) for introducing liquid and/or gaseous fuel in dependence upon the load, or upon the output which is to be generated and/or upon the combustion quality or combustion stability also with regard to pollutant emission.

19. The method as claimed in claim 18, wherein at least two different stages for operation with gaseous and/or liquid fuel are used, using at least two feeds which are arranged one behind the other in the flow direction, or using at least one feed (29, 31, 33) in the transition section (40) via a fuel lance (15) and at least one feed (18, 19, 22) in the transition section (40) from the wall region into the burner interior space (17).

20. The method as claimed in claim 19, wherein gaseous or liquid pilot fuel is additionally introduced into the combustion airflow via a tip of the fuel lance (15).

21. The method as claimed in claim 18, wherein natural gas and/or synthesis gas and/or crude oil are used as fuel.

* * * * *